US007225645B1

(12) United States Patent
Henneberg

(10) Patent No.: US 7,225,645 B1
(45) Date of Patent: Jun. 5, 2007

(54) METHOD OF MAKING A SINGLE CROCHETED WORK-PIECE WITH AN INCORPORATED MEANDERING PATTERN

(76) Inventor: Leslie Howe Henneberg, 375 Eatontown Rd., Port Jervis, NY (US) 12771

( * ) Notice: Subject to any disclaimer, the term of this patent is extended or adjusted under 35 U.S.C. 154(b) by 213 days.

(21) Appl. No.: 11/136,994

(22) Filed: May 25, 2005

(51) Int. Cl.
*D04B 31/00* (2006.01)

(52) U.S. Cl. ..... 66/1 R; 66/170

(58) Field of Classification Search ..... 66/1 R, 66/170, 190, 191, 197, 169 R, 198
See application file for complete search history.

(56) References Cited

U.S. PATENT DOCUMENTS

| | | | | | |
|---|---|---|---|---|---|
| D121,954 | S | * | 8/1940 | Gorska | D6/603 |
| 2,299,300 | A | * | 10/1942 | Bjornson | 66/170 |
| 2,301,410 | A | * | 11/1942 | Kaplan et al. | 434/95 |
| 2,399,478 | A | * | 4/1946 | Ellis | 428/134 |
| 2,655,017 | A | * | 10/1953 | Bessie | 66/1 A |
| 3,886,768 | A | * | 6/1975 | Anderson | 66/195 |
| 4,354,443 | A | * | 10/1982 | Abrahamson | 112/440 |
| 4,578,036 | A | * | 3/1986 | Leighton | 434/95 |
| 6,314,769 | B1 | * | 11/2001 | Brandenburg | 66/198 |
| 6,994,642 | B2 | * | 2/2006 | Gerak et al. | 473/594 |

OTHER PUBLICATIONS

Beginners Guide Filet Crochet Leisure Arts Little books.

Beginner's Guide Ripple Afghans to Crochet Leisure Arts Little books.

Decorative Crochet Mar. 2005 No. 104, Les Editions De Saxe s. A. 20 rue Croix-Barret, F 69007 Lyon, France.

Afghans, Copyright 1970 Coats & Clark Inc. 430 Park Ave. New York, New York 10022 Eighth Edition—173.

Unexpected Knitting by Debbie New, Schoolhouse Press, 6899 Cary Bluff, Pittsville, WI 54466 Copyright 2003.

Pamphlet by Caron, copyright 1999, Caron International, Washington, N.C. 27889.

* cited by examiner

*Primary Examiner*—Danny Worrell
(74) *Attorney, Agent, or Firm*—Sandra M. Kotin

(57) ABSTRACT

A method of planning and fabricating a single crocheted work-piece that incorporates a meandering pattern. A special grid is constructed, the pattern placed in the grid, and the stitch combinations noted on the pattern line forming a "map". This map of the work-piece is carefully followed in the fabrication of the first round. The work-piece is fabricated by making a central piece that is the first round containing the complete meandering pattern line. The first round is constructed in two steps, a row 1A and a row 1B. Row 1A is not visible when the first round has been completed. Thereafter, encircling additional rounds are added until the work-piece has reached the desired size. Inside seams are connected to complete the work-piece. Alternating colors are used to emphasize the meandering pattern. New stitch combinations, specifically a three-way intersection and a four-way intersection, as well as inside and outside corners make the meandering pattern possible.

21 Claims, 10 Drawing Sheets

METHOD OF MAKING A SINGLE CROCHETED WORK-PIECE WITH AN INCORPORATED MEANDERING PATTERN

FIELD OF THE INVENTION

The instant invention relates to a method of fabricating a crocheted work-piece that incorporates a meandering pattern created using new stitch combinations and is made in a single piece.

BACKGROUND OF THE INVENTION

Handcrafts have been known since the dawn of time. The various needlework techniques of embroidering, crocheting and knitting are centuries old and were elevated to an art form in colonial America. Crochet techniques can offer many variations which have contributed to a variety of articles from the small and lacey to the large and colorful. Different patterns have been incorporated into crocheted pieces using a number of methods often determined by the skill of the crafter. Some articles can be made by fabricating a number of small squares or other shapes and fastening them together so that the final product exhibits a desired pattern. Designs can also be accomplished by changing the stitches and stitch combinations, by the use of more than one color, or a combination of both. A decorative complex pattern may also be added to a crocheted article after its completion using embroidery techniques.

The technique of filet crochet can be used to create articles that often incorporate letters and artistic designs. Filet crochet involves a graphed design that is worked in combinations of solids and spaces. It is usually worked in a fine thread so that the finished product resembles lace. The crafter works in one direction when working the right side rows and in the opposite direction when working on the wrong side rows. All rows are straight across and the finished pieces are often squares or rectangles though other shapes are possible. Any design that can be graphed in black and white squares can be made by filet crochet but it is usually used to fabricate place mats, doilies and other relatively small delicate articles made in a single piece and usually in a single color. The technique of filet crochet is not practical for constructing larger and more substantial articles such as afghans, wall hangings and garments.

Large articles such as afghans can be made in one piece using various crochet techniques. One method utilizes a large number of stitches that are maintained on the crochet hook. The crafter works back and forth across the rows. Other methods can use one stitch throughout the work-piece or several different stitches. Patterns or designs can be incorporated using different stitches, stitch combinations, or colors and additional adornments can be added by embroidery techniques after the crocheting has been completed. Afghans can also be made in strips or in small pieces such as squares, rounds or other shapes such as hexagons. The individual pieces are sewn or crocheted together after all have been completed. The order and arrangements of attaching the squares or strips will determine the look of the finished product. The best known type of afghan made from multiple small pieces is the "granny square" afghan where each square is made by starting with a circle of chain stitches and each row is built up around the circle. One or several colors can be used and the finished product can be as elaborate as the crafter desires. The techniques used to make afghans can also be used to make sweaters, coats and hats. Such articles can be made from squares or other small pieces, or the various parts of a garment can be made to specification as in the fabrication of a knitted garment.

Another popular afghan is constructed with a zigzag pattern often referred to as a ripple afghan. These are constructed by making a long line and building up row upon row until the desired length is reached. Only one stitch is maintained on the crochet hook at a time as the rows are worked. The zigzag effect is accomplished by increasing and decreasing stitches as the crafter works across each row. This type of afghan is made all in one piece. As with other crocheted articles made by building one row upon the next, the work is performed on both the right and wrong sides of the work-piece.

More intricate crocheted articles can also be accomplished by building on the techniques discussed above or by color blocking. These methods are described in "Decorative Crochet" published bimonthly by Les Editions de Saxe, S. A. of Lyon, France and in the United States at Danbury, Conn.

A number of new and very novel needlework designs and techniques were introduced in the book "Unexpected Knitting" by Debbie New, published by Schoolhouse Press of Pittsville, Wis. in 2003. One of these is designated 'labyrinth knitting'. This technique produces a garment knitted in one piece that incorporates a labyrinth pattern involving a series of right angle turns accomplished by increasing and decreasing stitches. The pattern is fabricated by casting on thousands of stitches which are worked on several long circular needles at one time. The long row of stitches has multiple increase and decrease markers. Though the entire garment is made in a few rows, maintaining the work amounts to a Herculean task.

No such design resembling labyrinth knitting has heretofore been accomplished in crochet. The closest pattern is one described in a single page instruction sheet published by Caron International of Washington, N.C. in 1999. That pattern is made by starting with a center motif and building wavy rows around it in alternating colors.

A review of patented art in the needlework crafts reveals that few patents have issued. The ubiquitous nature of this art may offer one explanation. A patent for a method of constructing a large article, specifically an afghan, was issued to Abrahamson in 1982. (U.S. Pat. No. 4,354,443) The afghan was made of a number of individual crocheted squares. The corner squares and peripheral squares of the afghan were fabricated with a decorative border added to designated outer edges. When the squares were joined together in a specific order the finished afghan had a decorative border around its entire periphery and no further border had to be added. It is possible to extend this method to produce a finished article with a more complex pattern as long as each square contains an element of the pattern that can fit with another element in an adjoining square.

There is no method of constructing a single crocheted work-piece with a labyrinth or complex meandering pattern. There is a need for such a method and one that does not require thousands of stitches to be held on one needle or on multiple needles at any time during the course of the fabrication. There is a need for stitch combinations that would enable the fabrication of a crocheted work-piece incorporating a meandering pattern.

BRIEF SUMMARY OF THE INVENTION

The present invention provides a method of fabricating a crocheted work-piece that incorporates a meandering pattern, that is worked in one piece, and that is worked with only one stitch maintained on the crochet hook at a time. The present invention also provides stitch combinations that make the meandering pattern possible.

It is an object of the present invention to provide a method of incorporating a meandering pattern into a single crocheted work-piece.

It is another object of the present invention to provide new stitch combinations that enable the fabrication of a meandering pattern so the finished work-piece has a cohesive and artistic appearance.

It is a further object of the present invention to provide a completed stitch combination that does not exhibit a top row and a bottom row.

Another object of the present invention is to provide a stitch combination having a completed appearance such that the initial stitch groups are completely covered and are not seen in the finished product.

A still further object of the present invention is to provide a method to construct a crocheted work-piece that is made as a single unit, that incorporates a meandering pattern and that requires one stitch to be worked on at any given time.

It is another object of the present invention that all work is performed on the same side of the work-piece.

A further object of the present invention is to provide stitch combinations that are easy to count.

The present invention is a method of fabricating a single crocheted work-piece incorporating a meandering pattern. The size and shape of the work-piece must be determined first, then the gauge for the work-piece is determined by constructing a sample piece using the yarn, crochet hook and basic stitch to be used in the fabrication of the work-piece. A grid is made of the same shape as the work-piece and divided into uniform squares wherein each square represents a specific area determined using the size and the gauge. The meandering pattern is placed into the grid in the form of a single continuous line that crosses each of the squares and encloses an area designated the balloon and the balloon is compressed into a single pattern line that is superimposed on the cross-lines of the grid. Then the gauge is used to determine the number of stitch units to be placed in each square and notations for the required stitch units and stitch combinations are placed on the pattern line. The first round of the work-piece that incorporates every part of the pattern is fabricated, the fabrication being completed in two stages, a row 1A, the going out, and a row 1B, the return, using the numbers of the stitch units and stitch combinations designated in the grid, ending the round, and cutting the yarn. Another yarn is attached and a second round is fabricated by following around the pattern line and completely encircling the first round, ending with a slip stitch and cutting the yarn. The second round is repeated a sufficient number of times until the work-piece has attained the desired size and all inside seams are connected. The completed work-piece contains a meandering pattern and there is no right or wrong side to the work-piece, no top or bottom, and the initial row 1A is not visible.

The present invention is also a single crocheted work-piece incorporating a meandering pattern made by the method discussed above.

A method of constructing a first round of a crocheted work-piece incorporating a meandering pattern comprises the steps of fabricating a row 1A and fabricating a row 1B, whereby upon completion of row 1B the row 1A is no longer visible.

A single crocheted work-piece incorporating a meandering pattern comprises at least one three-way intersection and at least one four-way intersection.

Other features and advantages of the invention will be seen from the following description and drawings.

DETAILED DESCRIPTION OF THE INVENTION

Figure 1:
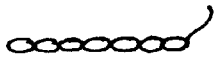
FIG. 1 (PRIOR ART)
FIG. 1 is a diagram of a line of chain stitches.
Figure 2:
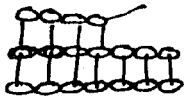
FIG. 2 (PRIOR ART)
FIG. 2 is a diagram of lines of crochet.

To understand the novelty of the present invention it may be necessary to examine the prior art method of crochet. All articles made by crochet may be begun by making a row of chain stitches as seen in FIG. 1. The row may contain only two or three "chain stitches" or it may contain several hundred "chain stitches" as would be used in the construction of a single large work-piece. Once the initial chain stitches have been completed, each successive row may be built up by making a new stitch in each chain stitch as seen in FIG. 2, or in every other chain stitch (or every third, etc.) according to the desired finished appearance. The top of each stitch may have the same appearance as a chain stitch so the fabricator knows where to insert the crochet hook for each successive row as the work-piece is being built row upon row. In all prior art crochet all rows, as well as the initial chain may be visible or may be easily located in the finished piece.

Figure 3:
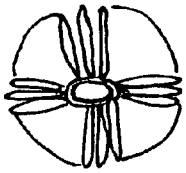
FIG. 3 (PRIOR ART)
FIG. 3 is a diagram of the first round of a Granny Square.
Figure 4:
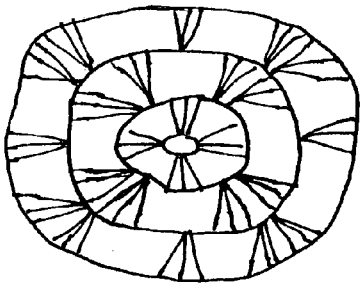
FIG. 4 (PRIOR ART)
FIG. 4 is a diagram of three rounds of a Granny Square.

In the Granny Square, a basic and versatile pattern, groups of three double crochet (dc) may be made in the same chain stitch and the group may be joined to the next group by one or two chain stitches. In construction, a short chain may be made and the ends of the chain may be joined to make a circle. The first row or round may have four groups of 3 dc evenly placed around the circle. (FIG. 3) The second row may have eight groups, the third row may have twelve groups and so on (FIG. 4) until the desired size of the piece is attained. Sometimes the outermost row may have a different finishing stitch combination to provide a decorative edge. The Granny Square is popular because it is easy to work and the square will grow evenly as the rounds progress so there is no figuring to be done.

Figure 5:
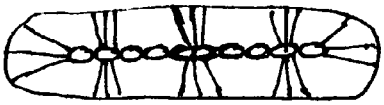
FIG. 5 (PRIOR ART)
FIG. 5 is a diagram of a rectangular piece of crochet.

A rectangle may be made by making a row of chain stitches and working the groups of dc four or five chain stitches apart directly across from each other on both sides of the initial chain. (FIG. 5) Successive rows may then be built on these groups.

Figure 6:
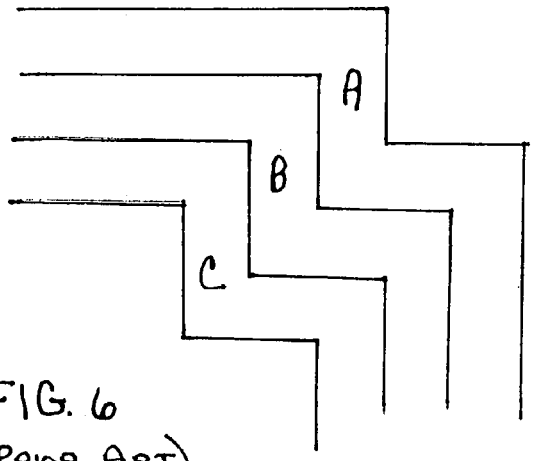
FIG. 6 (PRIOR ART)
FIG. 6 is a diagram of a zig-zag piece of crochet.

It may also be possible to fabricate a design that incorporates right angle turns or corners within the pattern. The corners may be effected by increasing or decreasing at the appropriate sites. When working in rows the work-piece is worked in one direction on the right side and in the opposite direction on the wrong side. The increases or decrease may also be accomplished on the same side of the beginning row of chain stitches. Any type of angular design has been possible so long as right and left turns are the only design elements needed. Several pieces may be made with this type of design element and the pieces may be joined together to produce a larger whole as long as the groups had been figured correctly before fabrication. See FIG. 6. If a piece is worked in the round, the design elements may be performed all around the initial circle of chain stitches on the same face of the work-piece.

Figure 7:
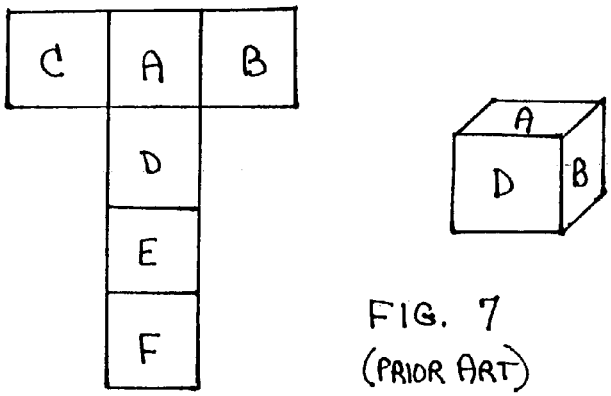
FIG. 7 (PRIOR ART)
FIG. 7 is plan view and perspective view of piece used to make a block.
Figure 8:
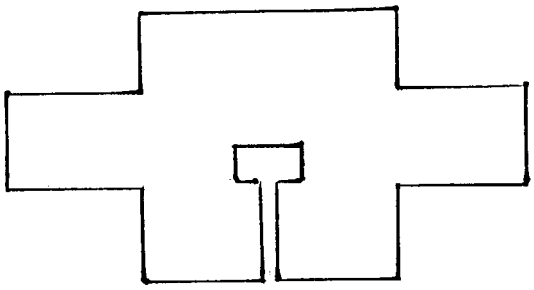
FIG. 8 (PRIOR ART)
FIG. 8 is a plan view of a sweater made in one piece before seams are joined.

When a shaped piece is worked in crochet, the end product may be suitable for a specific use. A large rectangle may be used as an afghan, a T-shape may be used for a child's toss cube (FIG. 7), and other shapes may be fabricated for a garment such as a sweater (FIG. 8).

A single work-piece incorporating a 3-way or 4-way intersecting stitch pattern has not heretofore been fabricated by working in crochet. The instant invention may accomplish this. The end result may be any shape that may be made by crochet. Two examples may be specifically described below, a small rectangular work-piece and a sweater, both of which may be completed with only six rounds. Similar work-pieces may require other numbers of rounds depending upon the type of yarn, stitches chosen, and size of crochet hook used. The work-pieces described may exhibit very unusual designs which may incorporate right turns and left turns as well as three-way and four-way intersections and which my be referred to as meandering patterns. All of the techniques described herein may incorporate clusters of three dc with no separating chain stitches. These clusters may make up the fabric of the work-pieces. However, it must be understood that the meandering patterns may also be made using any other crochet stitches and different combinations of stitches. The clusters may be separated by one or more chain stitches or by no chain stitches. This decision may be made by the crafter and may determine the degree of openness or laciness of the finished product and not the pattern itself. It is the predetermined twists and turns that constitute the meandering patterns. Blocking processes described herein may be used to design and fabricate the meandering patterns using the three dc clusters. These processes may also work with other stitch combinations which may include but are not limited to single crochet, half double crochet and triple crochet. The number of stitches in the various groupings and the number of rounds needed to complete a work-piece may necessarily be altered accordingly.

The meandering crochet patterns may not start with the usual chain stitches and the initial sequence of stitches may subsequently be covered so that it may not be visible in the finished product. The meandering pattern may be worked completely around the initial sequence so that there may not be an "up" or "down" to the pattern. All rows may be worked on the same side of the work-piece and both sides may look alike so that there may be no obvious "right side" or "wrong side" in the finished product.

Figure 9:
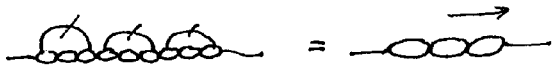
FIG. 9 is diagram of the construction of the links.

The meandering pattern may begin with a unit that may be referred to as the "link". Each link may be made as follows: ch (chain) 3, work 1 dc (double crochet) in the first ch. This sequence may be repeated a preset number of times to produce the desired length needed to begin the pattern and which may appear as a series of links attached end to end in FIG. 9. The meandering pattern may be carefully planned before the initial links are constructed and may necessitate formulating a grid on which the pattern may be blocked.

The particular design of a meandering pattern may determine the stitch combinations needed. As noted above, the various combinations may require new crochet configurations not heretofore found in the prior art. In addition to the link, the following new crochet configurations have been developed to enable the fabrication of meandering patterns: a 3-way intersection and a 4-way intersection. An inside corner, an outside corner and a U-turn may also be essential components of the meandering pattern. It may be necessary to master each of these configurations before constructing a work-piece with a full meandering pattern. In the fabrication of such a work-piece the construction may be accomplished by forming a single linear piece or first round containing all of the angles and intersections that make up the meandering pattern. Once the first round is completed the rest of the construction may be accomplished by simply crocheting around it in complete cycles or rounds until the desired size is attained.

A sequence illustrating a first round and a series of subsequent rounds may most easily be illustrated with a small rectangular sample piece. The first round of any work-piece constructed according to the methods described herein may actually consist of two components which may be designated as row 1A and row 1B. The row 1A may be the "going out" and the row 1B may be the "return". Once row 1B has been completed row 1A may not be visible.

The first round of the sample work-piece may be constructed by starting with a length of seven links which may constitute row 1A and which may be set forth as follows: *ch 3, work 1 dc in the first ch; rep from * six times. (rep=repeat) Once this sequence has been mastered the instructions may direct: make seven links. Each chain stitch (ch) in a link may consist of three threads. When making the dc in any ch of a link, the hook may be inserted below two threads of the ch and above one thread. In the construction of the initial seven links, row 1A, the piece may be worked from left to right.

Figure 10:
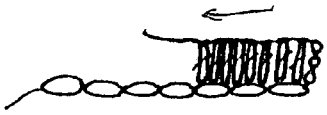
FIG. 10 is a diagram of row 1A and the beginning of row 1B.

The next sequence, row 1B, may be made by making a "U-turn" at the end of the last link as follows: ch 3, 1 dc in the second ch of the last link, and 1 dc in the first ch of the last link. This U-turn may always be used in the transition from a row 1A to a row 1B. The piece may now be worked from right to left by making 1 dc in each of the three ch of each of the next six links to complete row 1B. See FIG. 10. The grouping of 3 dc (and the ch 3 and 2 dc of the U-turn) may hereinafter be referred to as a "cluster" in this discussion. As noted above, other stitch groupings may be used to make up the fabric of the work-piece according to the appearance the crafter wishes to impart to the finished product. The combination of row 1A and row 1B taken together may form the actual first round or "center line" of the pattern.

When working row 1B the dc stitches may actually be worked around the dc of the link being covered so the completed first round may appear the same when viewed from the top or the bottom. At the end of the second round and all subsequent rounds the yarn may be secured with a slip stitch and may then be cut leaving a tail of several inches. The next color may be joined or the work may proceed with the same color.

Figure 11:
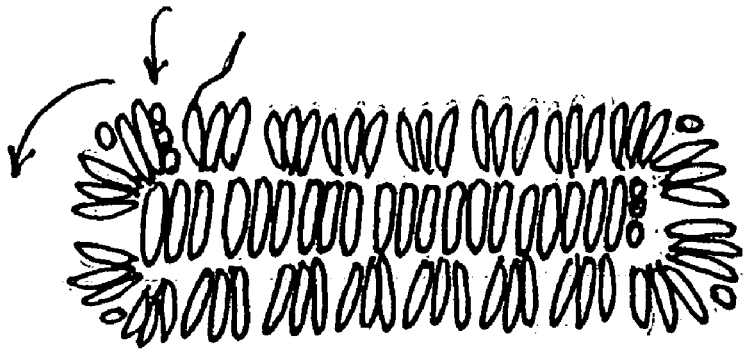
FIG. 11 is a diagram of the first round and the second round of a rectangular work-piece.

The second round may be begun in the top of the last dc of row 1B: ch 3, 2 dc, ch 1, 3 dc, all in the top of that same dc. This sequence forms one corner and may always be used as the beginning of a new round. For the second round, the next sequence is another corner, in subsequent rounds the corners may be separated by one or more clusters. The next corner sequence may be used for any outside corner: 3 dc, ch 1, 3 dc, all worked in the same space, which here may be in the bottom of the last dc of row 1B. One cluster may now be made in the space between each cluster (3 dc) of the first round. There may be six clusters on the side of the piece being worked. The next corner may now be worked by inserting the hook into the bottom of the end ch (the ch 3 of the U-turn at the start of row 1B) and making 3 dc, ch 1, 3 dc. This corner sequence may be repeated in the top of the end ch and working around the other side of the piece, one cluster may be made between each 3 dc. This may lead back to start of the second round. The last cluster may be joined to the first cluster of the round with a slip stitch and the yarn cut leaving a tail. (FIG. 11) Anew color may now be joined as before and a third round made. Each additional round adds clusters on each end. The corner sequences may be separated from each other by an increasing number of clusters as additional rounds are added. The same surface of the piece may always be facing the crafter and the work may be performed from right to left around the work-piece. Each successive round may be begun by attaching the yarn to the ch 1 at a corner and making the sequence of ch 3, 2 dc, ch 1, 3 dc, in the space below that same ch and thereafter proceeding around the work-piece. When viewing the completed work-piece it may be seen that the first round may be the center line of the piece and there may be no top or bottom.

The meandering pattern may only be seen if it is worked in a different color than that of the next round or rounds. Therefore each round may be completed and the yarn cut so the next round may be made in a different color. However, two or more succeeding rounds may be made in the same color as long as there are sufficient changes in color to define the meandering pattern.

Figure 12:
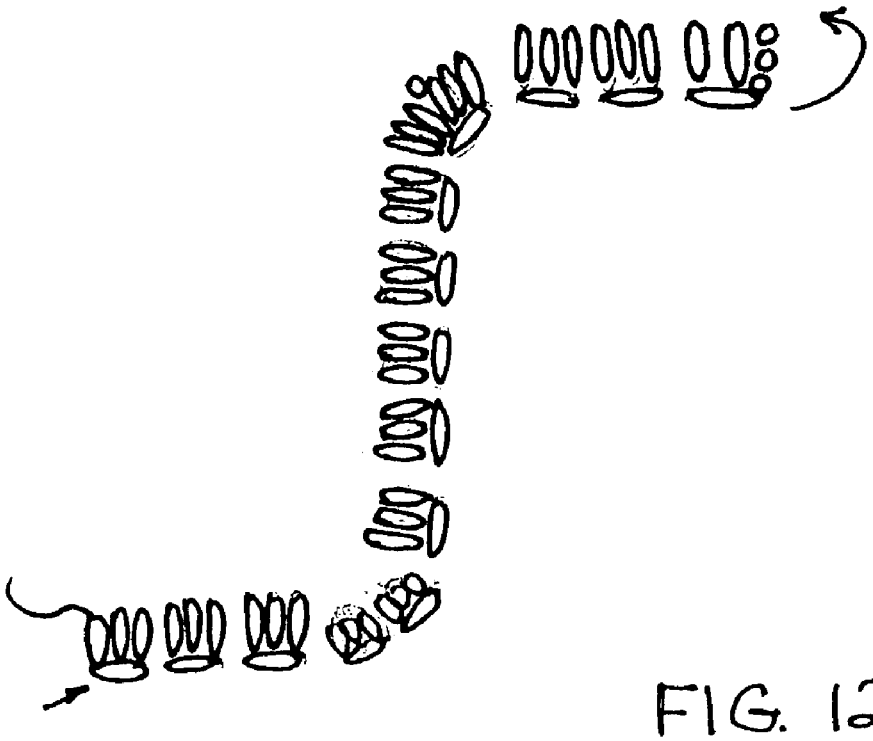
FIG. 12 is a diagram of row 1A and row 1B of an angled work-piece.

The next sequence necessary to the construction of a meandering pattern may be the 90° turn which may result in the formation of an outside corner or an inside corner depending on the direction the particular 90° turn may take. To illustrate the formation of the inside corner and the outside corner another sample work-piece beginning with a chain of fourteen links (row 1A) may be fabricated. Row 1B may be initiated as described above with a U-turn in the last link made, then 1 dc may be made in each ch of each of the next two links (three clusters made). In the next link an "outside turn" may be made: 2 dc in the first ch of next link, 1 dc, ch 1, 1 dc, in the second ch of the same link, and 2 dc in the third ch of the same link. A cluster may now be made in each of the next five links. To make an "inside corner" a "3 double decrease" (3dd) may be worked in each of the next two links. [A 3dd is accomplished as follows: yarn over (yo) the hook, insert the hook in the first ch of the link, pull up a loop, yo and pull through two loops, *yo hook and insert the hook in the next ch of the link, pull up a loop, yo and pull through two loops, repeat from * once more, yo and pull through all 4 loops.] The 3dd may only be used in a row 1B of the first round. A cluster may be made in each of the remaining three links to complete row 1B. See FIG. 12. The first round may be ended with a slip stitch and the yarn cut. The next color may be joined as noted above to make the second round.

The second round and all successive rounds may be fabricated in the same manner as discussed above. After joining the next color yarn with ch3, 2 dc, ch 1, 3 dc in corner of the previous round, each end corner may be formed with 3 dc, ch 1, 3 dc, and clusters of 3 dc may be made in the space between each of the clusters of the first round. The inside and outside corners of the 90° turns may be maintained in the second and successive rounds. The outside corner may be made in the same manner as each end corners (3 dc, ch 1, 3 dc) and may be made in the ch 1 of the outside corner combination of the first round. The inside corner may be made with two "puffs". Each puff (pf) may be worked in the space between a cluster and the adjacent 3dd of the first round. A puff may be worked as follows: *yo the hook, insert hook between cluster and the 3dd, pull up loop, yo and pull through 2 loops, repeat from * twice, yo and pull through all 4 loops. The two puffs may form the inside corner. In the third and successive rounds each inside corner puff is worked between a cluster and the adjacent puff of the preceding round.

Figure 13:
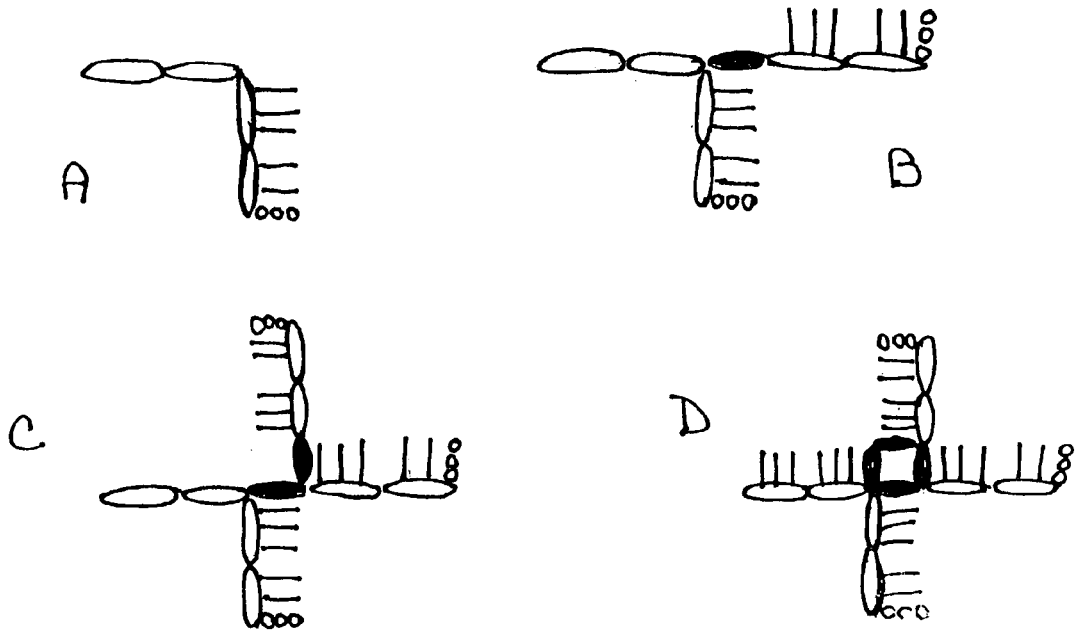
FIGS. 13 A-D are diagrams showing the steps in fabricating a four-way intersection.

Another important sequence in the fabrication of the meandering pattern may be the four-way intersection. The four-way intersection may occur at one or more points within a meandering pattern and may also be best described by constructing a sample work-piece that only contains this configuration. The sample work-piece may be made as follows: make a chain of four links, make the U-turn in the last link (first cluster), make a cluster (second cluster) in the next link FIG. (13-A); make a puff in the ch between the second cluster and the next link (this may be between the first and second legs of the four-way intersection); make two additional links; make a U-turn in the last link; make a cluster in the next link (third leg, FIG. 13-B); make another puff between the last cluster and the first puff; make two more links; make the U-turn in the last link; make a cluster in the next link (fourth leg, FIG. 13-C); make a puff between the last cluster and the last puff; make a puff between the first puff made and the next adjacent link; make a cluster across the last two links (the first two links made) to complete the first leg (FIG. 13-D). The work-piece may be ended with a slip stitch and the yarn cut. Second and successive rounds may be made by attaching the next color at an end of any of the four legs and proceeding around each leg, bearing in mind that an inside corner is worked at each point of intersection and outside corners are worked at the ends of each leg.

Figure 14:
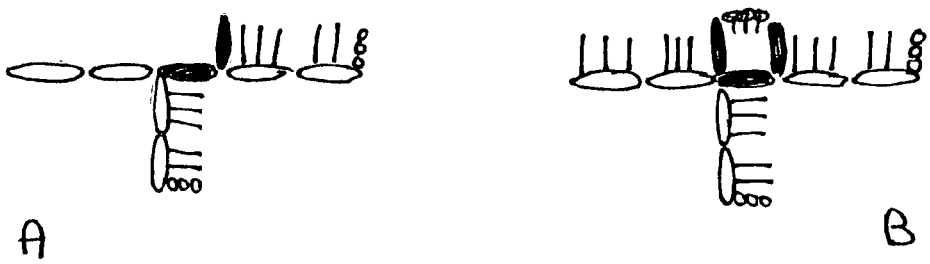
FIGS. 14 A and B are diagrams showing steps in fabricating a three-way intersection.

The last of the required combination may be the three-way intersection which may be fabricated as follows: make four links, make a U-turn in the last link, and a cluster across the next link; make a puff between the cluster and the next link; make two links, make a U-turn in the last link and a cluster across the next link; make a puff between the cluster and the first puff (FIG. 14-A); make a short puff (spf) [ch 3, *yo hook, insert hook in 1$^{st}$ ch pull up a loop, yo and pull through 2 loops, rep from * once, yo and pull through all 3 loops]; make a puff between the first puff and the next link, make clusters in the last two links, end with a slip stitch. (FIG. 14-B) The second and successive rounds may be made as previously described.

The three-way and four-way intersections may be approached from any one of the three or four legs depending upon the particulars of the meandering pattern chosen. The stitches may be worked as described, but the order may vary.

Any work-piece incorporating a meandering pattern must be carefully planned and "blocked" on a grid consisting of a series of squares. The pattern must cross each of the squares to insure that the finished work-piece may have the desired shape and exhibit the desired pattern.

Figure 15:
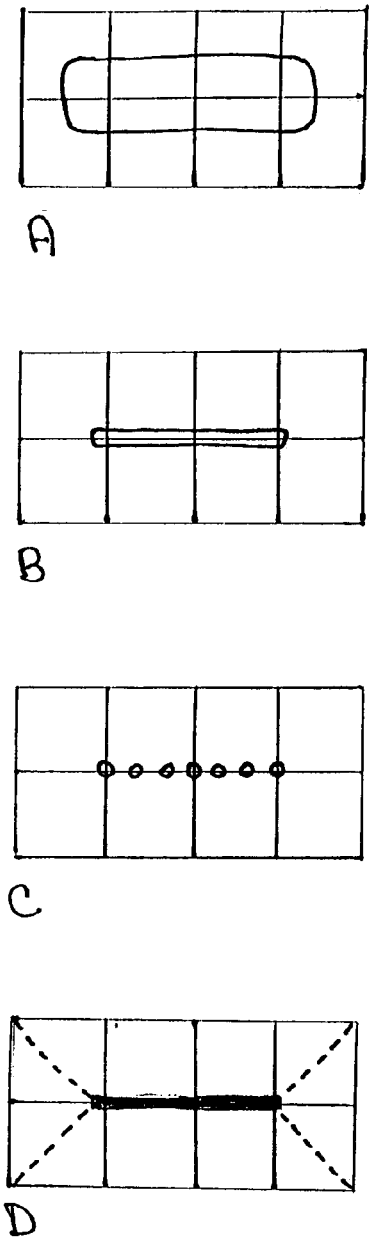
FIGS. 15 A-D are grids needed to make a rectangular work-piece.
Figure 16:
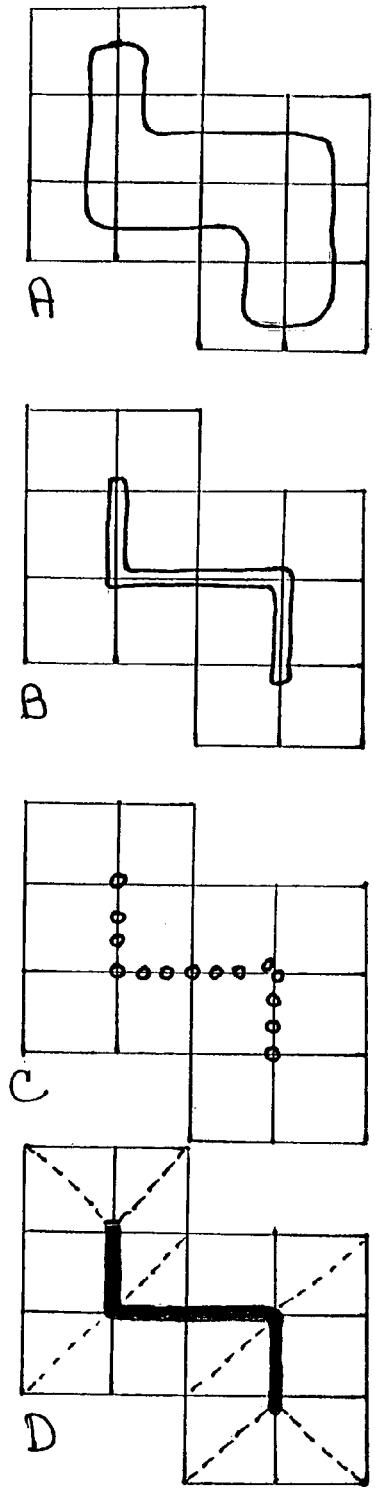
FIGS. 16 A-D are grids needed to make an angled work-piece.

The blocking may be shown for two of the samples described above. The first, the rectangular work-piece, may be shown in a 4×2 grid that may represent a 4 in×2 in finished work-piece. The pattern may be placed in the grid by ma king one continuous line that crosses all of the squares in the grid and returns to the starting point. (FIG. 15-A) The pattern may be shown first as a sort of balloon. The enclosed area may then be compressed to the intersections of the squares (FIG. 15-B) and the links of the first round placed in the compressed area (FIG. 15-C). Using the scale 3 clusters=3 in and 6 round=6 in the links may be placed in the grid, 3 links to square, and may form the instruction sheet for the fabricator. The placement of three links to a square with a link on each corner may indicate that there should be seven links to row 1A. The same method may be illustrated for the second sample with the 90° turns. The grid may follow the 90° angles as seen in FIGS. 16 A-D. It may be seen from this example that the work-piece and the grid do not have to be a rectangle or a square, but the grid must be made up of an even number of squares and reflect the shape of finished work-piece. Once the grid is constructed and the balloon made and compressed, the links that are to make up row 1A may be placed in the grid. FIG. 16-C represents row 1A for this work-piece, and it may be seen that 14 links are needed. Note that two links are used for the outside corner and these are seen on the grid. FIGS. 15-D and 16-D may represent the finished work-pieces and the dotted lines may indicate stitch patterns that may result from the inside and outside corner stitch combinations and which are visible in the finished product.

When the preceding stitch combinations and blocking methods have been mastered a work-piece incorporating a meandering pattern may be fabricated. The first step may be the determination of the dimensions of the completed work-piece. The second step may be to make a small sample piece to determine the gauge that will result with the yarn type, crochet hook, and basic stitch chosen for the project. The sample piece may provide the number of stitches and rounds in one or two inches of crochet. The next step may be the construction of a grid in the appropriate shape and being marked into squares according to the size and gauge that have been determined. The following step may be drawing the continuous line (the balloon) that crosses all of the squares and incorporates the desired meandering pattern, then the compression of the balloon so the meandering pattern may be seen on the lines of the grid. The last and most crucial step may be placing the link sequence on the grid. The link sequence may be the actual instruction sheet or "map" for the crafter to follow in the construction of the work-piece, more specifically in the construction of row 1A of the work-piece. If desired, the instructions may be written out, but they may originate from the grid.

Figure 17:
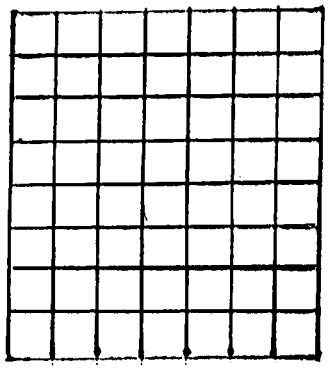
FIG. 17 is a grid on which to block a work-piece.
Figure 18:
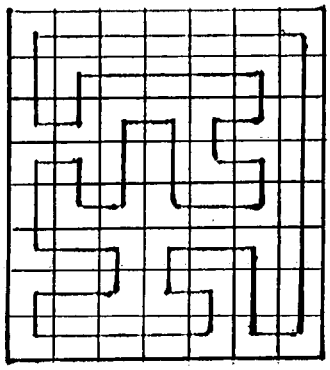
FIG. 18 is the grid of FIG. 17 with the initial balloon needed to make the work-piece.
Figure 19:
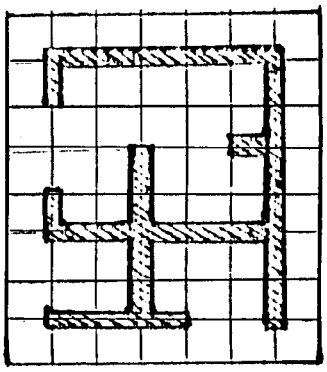
FIG. 19 is the grid of FIG. 18 with the balloon partially compressed.
Figure 20:
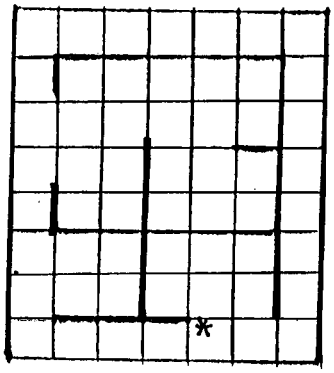
FIG. 20 is the grid of FIG. 19 with balloon completely compressed and showing the meandering pattern to be fabricated.
Figure 21:
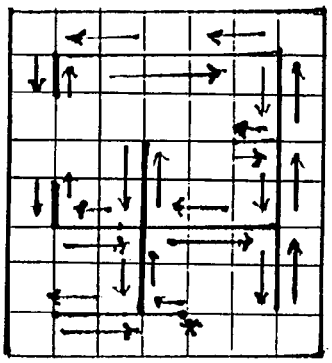
FIG. 21 is the grid of FIG. 20 showing the path to be followed for the first round.
Figure 22:
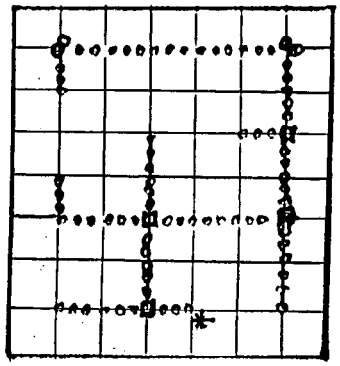
FIG. 22 is the grid of FIG. 21 with the links shown in the meandering pattern.

A rectangular work-piece incorporating a meandering pattern may be constructed to illustrate the techniques discussed above. In this sample the gauge may be 3 clusters=3 in and 6 rounds=6 in. The completed work-piece may be 21 in×24 in and may be made with three colors in six rounds. A grid consisting of an even number of squares, in this case 56 squares, seven squares across and eight squares down as seen in FIG. 17, may be constructed. Each square may represent an area of 3 in×3 in. The desired pattern may be placed in the grid by drawing one single line, the balloon, that crosses each of the 56 squares as seen in FIG. 18. The area may then be compressed into a single line on the cross lines of the grid. (FIGS. 19 and 20) This compressed line may exemplify the meandering pattern that will be incorporated into the work-piece. One end of the line may be designated as the starting point of the pattern by * on the grid. Arrows may then be drawn to illustrate the directions that must be taken in the fabrication of the first round. The arrows going in one direction, going out, are illustrative of row 1A, and the arrows going in the other direction, returning, are illustrative of row 1B. See FIG. 21. The actual number of links and cross-sections may then be put into the grid. (FIG. 22) There may be 3 links to each square with the three-way intersection, four-way intersections and outside corners shown as separate entities. Once this step has been completed, the grid may be followed as the instruction sheet for the work-piece and the work may proceed.

Figure 23:
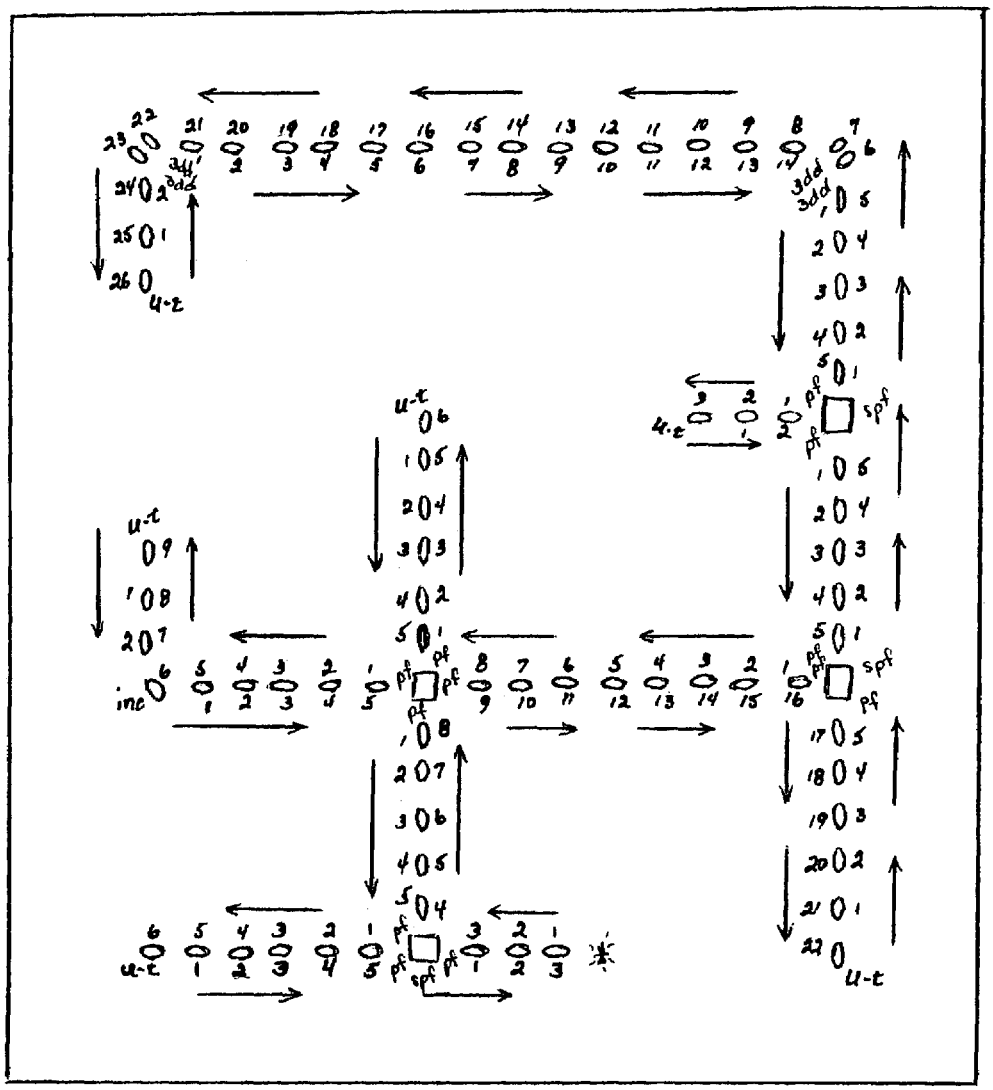
FIG. 23 is a diagram of the meandering pattern of FIG. 20 showing the path to be followed and each link, corner and intersection noted.

The grid may be expanded so that all of the stitches with directional arrows may be clearly seen, as shown in FIG. 23 in which numbers have been added to provide the number of links and clusters along each part of the pattern. Following FIG. 23 the first round may be made as follows: beginning at *, make 22 links, work U-turn in last link, make clusters in the next 5 links, work pf in the chain between the last cluster and the next link, make spf, make 5 links, make spf, make 26 links; make U-turn in last link, make 2 clusters, make 3 dd in each of the next two links (inside corner); make 14 clusters, make 3dd in each of the next two links (inside corner), make 5 clusters, make pf in chain between the 1st cluster and the spf, make 3 links, make U-turn, make 2 clusters, make pf in the chain between last cluster and the last pf, make pf in the chain between the spf and the next link, (this completes a three-way intersection); make 5 clusters, make pf in the chain between the last cluster and the spf, make pf in the chain between the first pf and the next link (this completes a three-way intersection); make 8 clusters, make pf in the chain between the last cluster and the next link, make 6 links, make U-turn, make 5 clusters, make pf in chain between the last cluster and the last pf, make 9 links, make U-tun, make 2 clusters, make an outside corner increase in next link (2 dc in 1$^{st}$ ch; 1 dc, ch 1, 1 dc in 2$^{nd}$ ch; 2 dc in 3$^{rd}$ ch); make 5 clusters, make pf in ch between the last cluster and last pf, make pf inch between first pf of this intersection and next link (this completes four-way intersection), make 5 clusters, make pf in ch between the last cluster and next link; make 6 links, make U-turn, make 5 clusters, make pf in ch between last cluster and last pf, make spf, (this completes three-way intersection), make 3 clusters, this returns to the point of beginning and completes the first round. End first color with a slip stitch and cut yarn leaving a tail of several inches. This complete sequence may be seen to, include row 1A (going out) and row 1B (returning) which together make up the first round. None of the beginning links will be visible with the completion of row 1B.

It may be noted that when the meandering pattern involves many twists and turns it may not be possible to complete the full row 1A before beginning row 1B. The first round may be fabricated in several segments. Row 1A may be completed for one segment, the U-turn made and row 1B begun, then at later points in the pattern new links, row 1A, U-turn and row 1B, may be added to form additional segments.

With the completion of the first round, the work-piece may be laid out on a flat surface and must match the map exactly. If it does not match the map the various ends may not fit together when the six rounds have been completed.

Round two may be begun by attaching the next color to the top of the last dc worked. Round two, and each successive round, may be worked from right to left completely around the piece. Round two may be begun with ch 3, 2 dc, ch 1, 3dc in the top of the last dc of round one, then 3 dc, ch 1, 3 dc in the bottom of the last dc of round one, and continuing by making one cluster in the space between each cluster (3 dc) of round one. At each inside corner make a pf between the last cluster and the 3dd of the first round, and another pf between the second 3dd of the first round and the next cluster. For each outside corner make 3 dc, ch 1, 3 dc in the space under the chain of the corner of the first round. When the second round is completed, join with a slip stitch and cut the yarn. Each successive round may be begun in the same manner and may be worked by alternating the colors. The work-piece may be finished with the completion of the sixth round.

Figure 24:
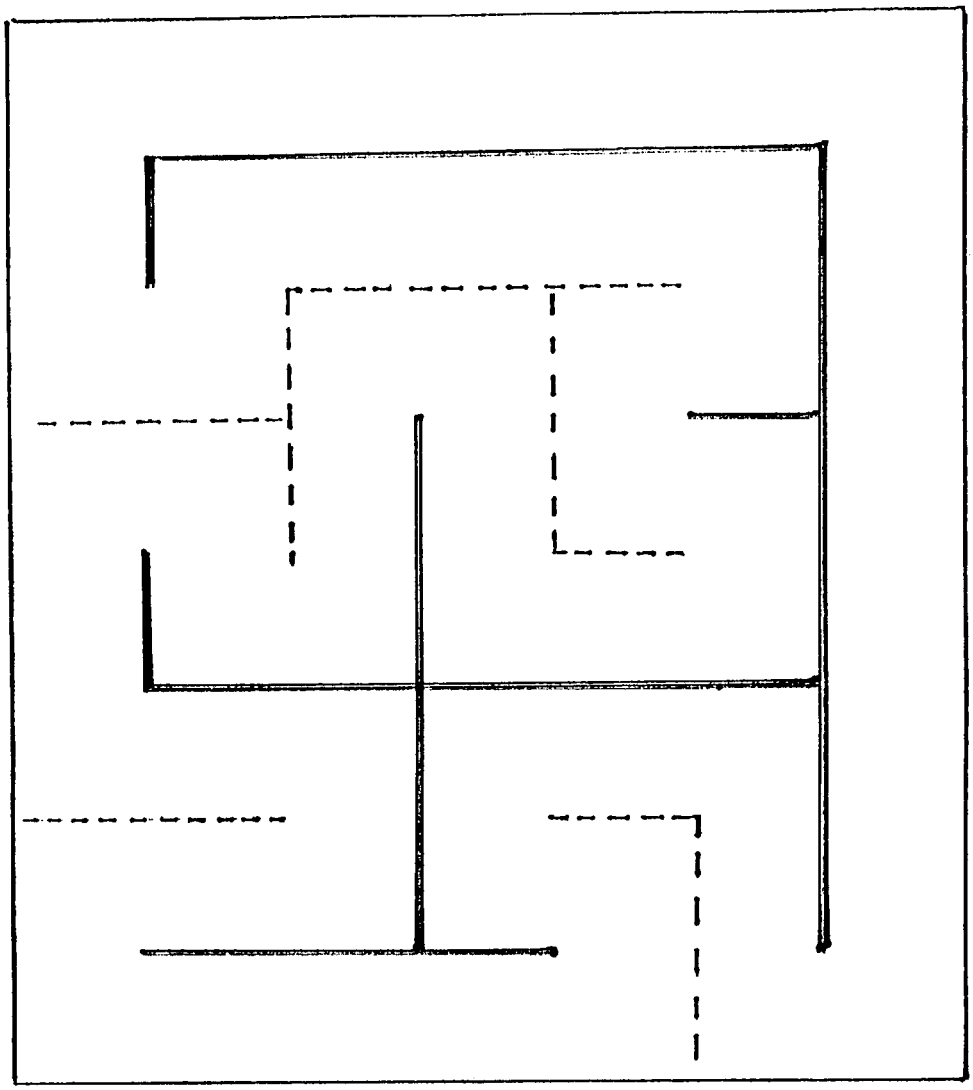
FIG. 24 is a diagram of the meandering pattern of FIG. 20 showing the seam lines.

At this point the work-piece may be placed on a flat surface. All inside edges should abut to form the completed rectangle. This may be seen in FIG. 24 in which the dotted lines represent the abutting edges. The dotted lines may also represent the seam lines indicating the several places where inside seams may be used to join these edges together. In the alternative, the edges may be joined by crochet techniques incorporated as part of the sixth round for this work-piece, or whichever may be the last round. It may be most important that the inside edges be lined up so that all parts fit together smoothly. For straight edges the clusters from one edge may correspond to the clusters on the opposite edge.

Figure 28:
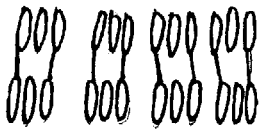
FIG. 28 is a diagram of joining of the inner edges.

If the inside edges are to be joined by crochet as part of the last round, the work may proceed to the first point where two inside edges are to be joined. The first dc of the next cluster may be worked, the loop removed from the hook and the hook inserted into end of the corresponding dc of the opposing edge and the loop pulled through. The second dc may be worked, then the third dc of the cluster, the hook removed and the loop pulled through the third crochet of the corresponding cluster of the opposing edge. Working across the straight edges, the first and third dc of the opposing clusters may be joined as seen in FIG. 28. The joining may always be preformed on the "return" part of the round, not the "going out" part. The joining of the first and third dc of opposing clusters may also be followed at the corners. Where there are two puffs in an inside corner, the joining may be accomplished between the corner clusters of the outside corner and the clusters adjacent to the puffs of the inside corner. Any other joining techniques known in the art may be used to join the inside edges.

Figure 25:
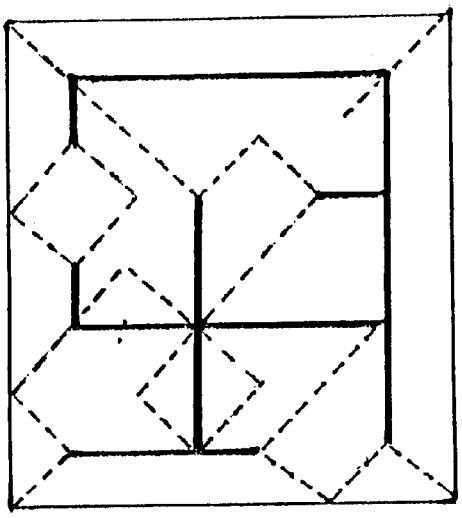
FIG. 25 is a diagram of the meandering pattern of FIG. 20 showing the corner lines.

Once all inside seams have been joined, a decorative edge around the entire rectangle may be added as desired Proper construction of the corners of the work-piece, specifically the 3 dc, ch 1, 3dc for the outside corners, the increases, and the puffs of the inside corners, the decreases, may result in stitch patterns in the finished product. These stitch patterns may add another design element to the meandering pattern and may be seen as the dotted lines in FIG. 25.

The meandering pattern chosen for a work-piece may be as simple or as complex as the crafter desires and may be capable of constructing. Careful blocking of the pattern and the determination of the gauge by making a small sample may be crucial to having the finished product conform to the dimensions selected at the outset and to insure that the inside seam lines or joining lines match exactly. The beauty of this construction may be twofold. First, the entire work-piece may be constructed as one single piece, and second, the crafter may work with only one stitch on the hook at any given time.

As may be concluded from the above discussion, it may be the first round that requires careful concentration and necessitates closely following the chart or graph that was prepared before the work was commenced. Once the first round has been completed, the crafter need only proceed around the pattern one round at a time making only clusters, inside corners and outside corners. There may be no further need to refer to a chart or an instruction sheet except, perhaps to check where the edges must be connected at the seam lines when all crochet has been completed.

Figure 26:
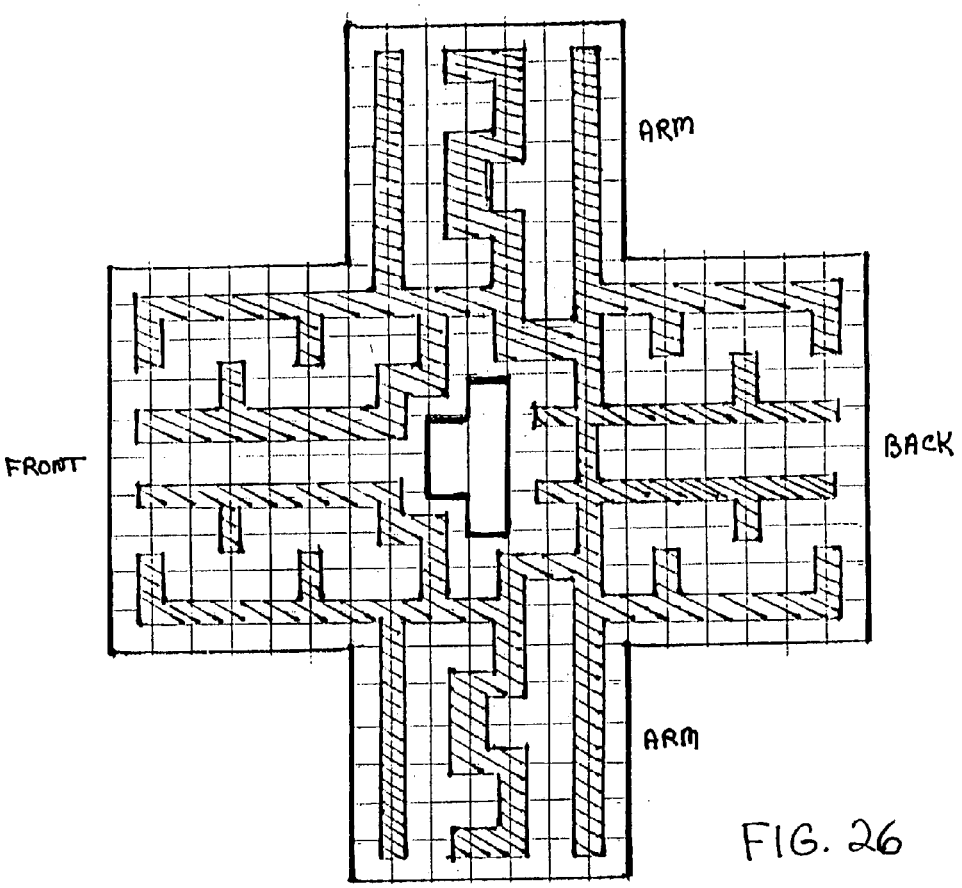
FIG. 26 is grid with a meandering pattern designed for the fabrication of a sweater made in one piece.
Figure 27:
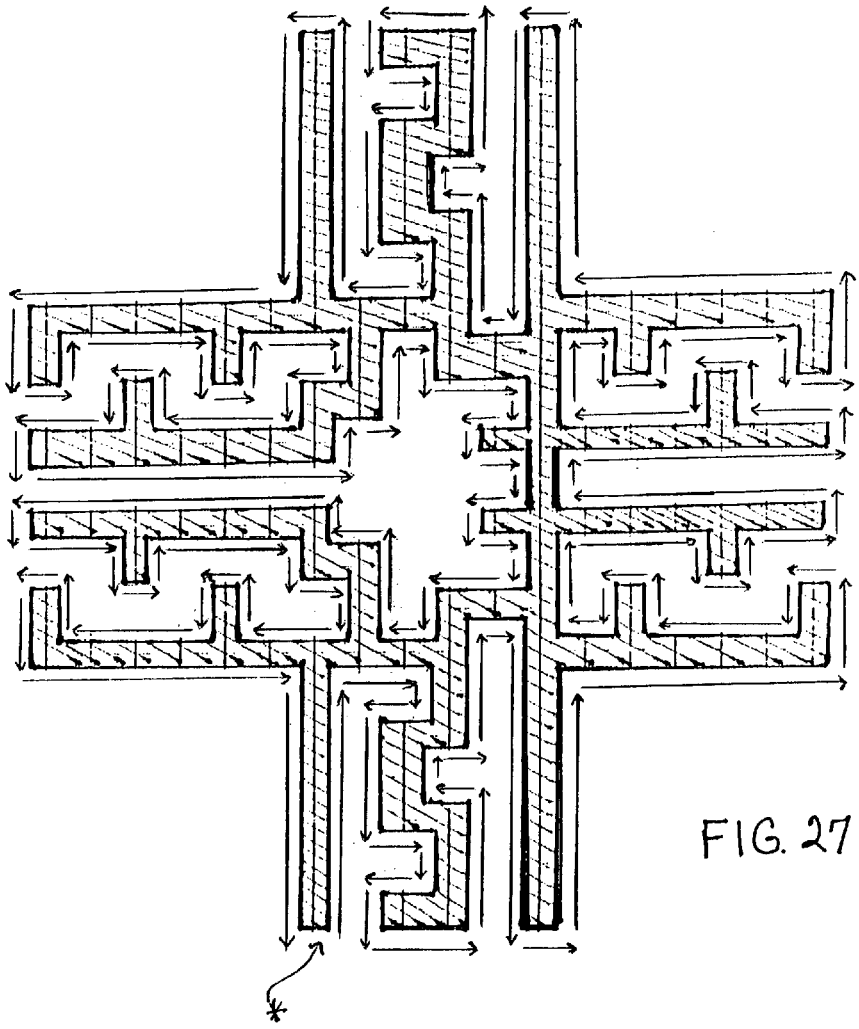
FIG. 27 is a diagram of the meandering pattern of FIG. 26 showing the path for the first round.

Garments may also be made incorporating a meandering pattern. A garment may be constructed of several individual pieces, each blocked and fabricated separately, or the entire garment may be made in one piece. A sweater may be fabricated in one piece provided the piece is properly blocked. FIG. 26 may be one such plan. In this figure initial balloon has not been compressed completely to emphasize the meandering pattern chosen. This plan may include an opening for the neck of the sweater. Upon completion, the inside edges may be seamed or connected as part of the last round. The front sections may not be connected so the sweater may be worn as a cardigan, or alternatively, the front sections may be connected and the sweater worn as a slipover. The arrows seen in FIG. 27 may show the directions to be followed in fabricating the first round. Again, once the first round is completed, each successive round may be made by working completely around the initial piece. The garment illustrated in FIGS. 26 and 27 may be designed to be worked in six rounds using the same gauge, yarn type and crochet hook size as used in the work-pieces described above. FIG. 27 may also illustrate what the first round may look like when it is placed on a flat surface.

The work-pieces described herein have been fabricated using worsted yarn and a size G crochet hook, or size hook needed to achieve the gauge noted above. Any yarn with an appropriate size hook may be used as long as the pattern is properly blocked and a sample piece is made to insure that the gauge is correct for the pattern. If this is not done, the sections of the pattern may not match up and inside seams may not lie flat.

As previously noted, crochet stitches other than double crochet and groupings other than the three double crochet cluster may be used as long as they can be fitted into a proper grid and an accurate gauge is formulated.

While several embodiments of the present invention have been illustrated and described in detail, it is to be understood that this invention is not limited thereto and may be otherwise practiced within the scope of the following claims.

I claim:

1. A method of fabricating a single crocheted work-piece incorporating a meandering pattern and comprising the steps of:

determining the size and shape of the work-piece;

determining the gauge for the work-piece by constructing a sample piece using the yarn, crochet hook and basic stitch to be used in the fabrication of the work-piece;

making a grid of the same shape as the work-piece;

dividing the grid into uniform squares wherein each square represents a specific area determined using the size and the gauge;

placing the meandering pattern into the grid in the form of a single continuous line that crosses each of the squares and encloses an area designated the balloon;

compressing the balloon into a single pattern line that is superimposed on the cross-lines of the grid;

using the gauge to determine the number of stitch units to be placed in each square;

placing notations for the required stitch units and stitch combinations on the pattern line;

fabricating a first round of the work-piece that incorporates every part of the pattern, said fabrication being completed in two stages, a row 1A, the going out, and a row 1B, the return, using the numbers of the stitch units and stitch combinations designated in the grid, ending the round, and cutting the yarn;

attaching another yarn and fabricating a second round by following around the pattern line and completely encircling the first round, ending with a slip stitch and cutting the yarn;

repeating the second round a sufficient number of times until the work-piece has attained the desired size; and connecting all inside seams;

whereby the completed work-piece contains a meandering pattern and there is no right or wrong side to the work-piece, no top or bottom, and the initial row 1A is not visible.

2. The method of claim 1 wherein the stitch units and stitch combinations comprise:

chains (ch), double crochets (dc), links, U-turns, clusters, 3 double decreases (3dd), puffs, short puffs, inside corners, outside corners, three-way intersections, and four-way intersections.

3. The method of claim 2 wherein a link comprises the grouping of: chain (ch) 3, dc in the first chain.

4. The method of claim 3 wherein a U-turn comprises the grouping of: ch 3, 2 dc in the bottom of the last link made.

5. The method of claim 4 wherein a cluster comprises a stitch combination selected from the group consisting of 3 dc and the U-turn.

6. The method of claim 5 wherein a 3 double decrease (3dd) comprises: yo the hook, insert the hook in the first chain of a link, pull up a loop, yo and pull through two loops, * yo and insert the hook in the next chain of the link, pull up a loop, yo and pull through two loops, repeat from * once more, yo and pull through all 4 loops.

7. The method of claim 6 wherein a puff (pf) comprises: * yo the hook, insert hook between a cluster and an adjacent stitch combination, pull up a loop, yo and pull through 2 loops, repeat from * twice, yo and pull through all 4 loops.

8. The method of claim 7 wherein a short puff (spf) comprises; chain 3, * yo hook, insert hook in first chain pull up a loop, yo and pull through 2 loops, repeat from * once, yo and pull through all 3 loops.

9. The method of claim 8 wherein an inside corner in the first round comprises: 3dd in one link within a series of links, 3dd in the adjacent link.

10. The method of claim 9 wherein an outside corner in the first round comprises: 2 dc in the first ch of one link within a series of links, 1 dc, ch 1, 1 dc in the second ch of the same link, 2 dc in the third ch of the same link.

11. The method of claim 10 wherein a three-way intersection comprises: making a pf between a cluster and the next adjacent link in a series of links, making a new series of links, making a U-turn at the end of the new series, making clusters across the remaining links in the new series, making a pf between the last cluster made and the first pf, making a spf, making a pf between the first pf and the next adjacent link.

12. The method of claim 10 wherein a four-way intersection comprises: making a pf between a cluster and the next adjacent link in a series of links, making a first new series of links, making a U-turn at the end of the first new series, making clusters across the remaining links in the first new series, making a pf between the last cluster made and the first pf, making a second new series of links, making a U-turn in the end if the second new series, making clusters across the remaining links in the second new series, making a pf between the last cluster made and the last pf, making a pf between the first pf and the next adjacent link.

13. The method of claim 7 wherein the fabrication of the second round comprises the steps of: attaching a new yarn at one corner of the work-piece, making ch 3, 2 dc, ch 1, 3 dc in the top of the last dc of the first round, working completely around the work-piece by making a cluster between each two clusters of the first round, making 3 dc, ch 1, 3 dc in each outside corner, making a pf between the last cluster and the 3dd of the first round and another pf between the second 3dd of the first round and the next cluster in each inside corner, joining the yarn to the beginning ch 3 with a slip stitch and cutting the yarn leaving a tail.

14. The method of claim 1 wherein after completing the last round the inside seams are connected by sewing.

15. The method of claim 1 wherein after completing the next to the last round the inside seams are connected by crochet during the fabrication of the last round.

16. The method of claim 15 wherein the inside seams are connected by a crochet technique comprising the steps of: making the first dc in a cluster, removing the loop from the hook, inserting the hook in the corresponding dc in the cluster of the opposing edge to be joined and pulling the loop through, making the second dc of the cluster, making the third dc of the cluster, removing the loop from the hook, inserting the hook in the corresponding dc of the opposing edge, pulling the hoop through, repeating these steps as needed until the seam line has been connected.

17. The method of claim 1 comprising the additional step of making a decorative edging around the entire work-piece wherein all of the inside seams reaching the perimeter of the work-piece are smoothed over with the decorative edge and the work-piece lies flat.

18. The method of claim 2 wherein the stitch units and stitch combinations further comprise:

stitches selected from the group consisting of single crochet (sc), half double crochet (hdc) and triple crochet (tc).

19. A single crocheted work-piece incorporating a meandering pattern made by the method of claim 1.

20. A method of constructing a first round of a crocheted work-piece incorporating a meandering pattern comprising the steps of:

fabricating a row 1A from a series of crocheted links; and fabricating a row 1B using stitch units and combinations to completely enclose row 1A;

whereby upon completion of row 1B the row 1A is no longer visible and the first round constitutes the core of the meandering pattern.

21. A single crocheted work-piece incorporating a meandering pattern comprising at least one three-way intersection and at least one four-way intersection, said intersections each comprising at least three arms, each being fabricated from a row 1A and a row 1B, said row 1B completely enclosing the row 1A so that it is no longer visible, and at least three connecting means for connecting the at least three arms at a central point.

* * * * *